US006404701B1

(12) United States Patent
Stottlemyer

(10) Patent No.: US 6,404,701 B1
(45) Date of Patent: Jun. 11, 2002

(54) ENCAPSULATED VOLUMETRIC ACOUSTIC ARRAY IN THE SHAPE OF A TOWED BODY

(75) Inventor: Thomas R. Stottlemyer, Mystic, CT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/906,007

(22) Filed: Jul. 16, 2001

(51) Int. Cl.[7] ..... H04R 17/00

(52) U.S. Cl. ..... 367/20; 367/106; 367/154; 367/130

(58) Field of Search ..... 367/20, 153, 154, 367/106, 130; 174/101.5

(56) References Cited

U.S. PATENT DOCUMENTS 3,900,543 A * 8/1975 Davis ..... 174/101.5
4,733,379 A * 3/1988 Lapetina et al. ..... 367/20
4,862,428 A * 8/1989 Jackett et al. ..... 367/155
5,241,519 A * 8/1993 Monahan et al. ..... 367/154
5,412,621 A * 5/1995 Hepp ..... 367/154
5,777,954 A * 7/1998 Hepp ..... 367/20

* cited by examiner

*Primary Examiner*—Ian J. Lobo
(74) *Attorney, Agent, or Firm*—Michael J. McGowan; Prithvi C. Lall; Michael F. Oglo

(57) ABSTRACT

An encapsulation assembly includes a housing having a nose end, a tail end, and a body portion between the nose end and the tail end. A plurality of acoustic transducers are positioned within the body portion of the housing, each of the plurality of acoustic transducers having a wiring connection attached thereto. A tow cable is connected to the nose end of the housing and is in communication with the wiring connection from each of the plurality of acoustic transducers. A characteristic of the assembly is that at least the body portion of the housing is entirely formed of a solid casting of plastic material thereby environmentally isolating the plurality of acoustic transducers within the body portion of the housing. This configuration prevents water intrusion into the transducer elements, and increases the cavitation threshold for the acoustic array, thereby allowing the array to be driven to higher acoustic intensities.

7 Claims, 1 Drawing Sheet

ENCAPSULATED VOLUMETRIC ACOUSTIC ARRAY IN THE SHAPE OF A TOWED BODY

STATEMENT OF GOVERNMENT INTEREST

The invention described herein may be manufactured and used by or for the Government of the United States of America for governmental purposes without the payment of any royalties thereon or therefor.

CROSS-REFERENCE TO RELATED PATENT APPLICATIONS

Not applicable.

BACKGROUND OF THE INVENTION (1) Field of the Invention

This invention generally relates to a towed acoustic source. More particularly, the invention relates to a towed acoustic source that consists of a volumetric array of transducers encapsulated in a solid block of material, the solid block of material particularly formed in the shape of a towed body.

(2) Description of the Prior Art

Traditionally, towed active sonar arrays are made of metal or composite structures that house transducer arrays. The transducers themselves have rubber boots surrounding them to prevent water from intruding, and the towed body itself is free-flooding. The towed body is connected to a vessel by an electro-optical-mechanical tow cable. Thus, a problem exists in the art whereby it is necessary to separately protect the transducers from seawater within the towed body in order to preserve the electrical connections.

The following patents, for example, disclose various types of towed acoustic devices, but do not disclose an array of transducers encapsulated within a solid block of material, the solid block of material forming the external shape of the towed body as does the present invention.

U.S. Pat. No. 5,781,506 to Peloquin;

U.S. Pat. No. 5,856,954 to Grall;

U.S. Pat. No. 5,909,408 to Warnan et al.;

U.S. Pat. No. 6,050,361 to Ruffa et al.; and

U.S. Pat. No. 6,088,296 to Seaman et al.

Specifically, Peloquin disclose a method and system provided for frequency filtering compressional wave energy. An elastic cylinder is filled with fluid that is selected based on a fluid density $\rho_1$, and a dilational wave phase velocity $c_1$ thereof. An elastic cylinder so-filled is subjected to a compressional wave propagating in a fluid environment, a first radial resonance frequency of the elastic cylinder is controlled by the fluid density $\rho_1$ and the dilational wave phase velocity $c_l$. Further tuning of the first radial resonance frequency can be achieved by adjusting the radial wall thickness of the elastic cylinder.

The patent to Grall discloses a process of acoustic emission for sonar with a separate emission array from the receiving array. The emission array has the shape of a linear acoustic array and can either be towed simultaneously with a linear acoustic receiving array or be suspended from a helicopter to form a "dipping" type sonar. Detection using this type of sonar is facilitated by increasing the sound level via the directivity index, while reducing the level of reverberation originating from the bed and from the surface of the sea.

Warnan et al. discloses a towed acoustic transmitter forming an underwater vehicle which is itself intended for towing a linear acoustic receiving array. It consists in placing the vertical faired acoustic array of such a transmitter at the very rear of the underwater vehicle, and in balancing the weight of this array by a faired ballast situated at the very front thereof. These two parts are joined by a girder of a small cross-section, and the center of gravity of the whole is situated at the front of this girder and beneath it. The vehicle is towed by a cable fastened to the vehicle by a hook fixed to a swivel joint above the center of gravity. This towing makes it possible to facilitate the operations of submersion and fishing-out of the whole while also achieving a greater depth of submersion.

Ruffa et al. discloses a cavitation-resistant sonar array having reduced spacing between transducer elements. The array has a series of transducer elements attached to an array fixture with spacing between elements being fixed at one-quarter wavelength or closer. Cavitation caused by this close spacing is eliminated by replacing water spaces between elements with a rho-c rubber which matches the acoustic impedence, $z$, of water, that is $z=\rho c$. The rho-c material is bonded to the transducer elements to prevent a loss of contact between the transducer elements and the spacer. A processing computation correcting the signal data is provided to account for any differences in the speed of sound, c, in the rho-c material when compared to the speed of sound in water.

Seaman et al. disclose a soft body, towable, active acoustic module including a specially formed suspension fixture and a flexible faired body enclosing an active acoustic array. The suspension fixture is a Y-shaped termination having a single forward end and two trailing ends, one for attachment of a trailing tow cable and towed receiver array and the other for attachment of the flexible faired body. The flexible, faired body is an elongated hydrofoil having sections which allow lateral bending. The combination of the suspension feature and lateral bending feature allows the module to be deployed and recovered through underwater shipboard deployment tubes. A weight attached to the faired body near the lower rear end balances the body to maintain a substantially vertical position during towing.

It should be understood that the present invention would in fact enhance the functionality of the above patents by providing a solid casting of a waterproof material around a plurality of active acoustic elements, and more particularly, providing the solid casting in the shape of a towed body.

SUMMARY OF THE INVENTION

Therefore it is an object of this invention to provide an encapsulated acoustic array within a towed body.

Another object of this invention is to provide a towed body having the acoustic array thereof encapsulated in a solid casting of material, such as polyurethane or any other suitable material.

Still another object of this invention is to provide a towed body having the acoustic array encapsulated in a solid casting of material, such that at least a portion of the solid casting material defines an outer surface of the towed body.

A still further object of the invention is to provide a towed body formed of a solid casting material, the solid casting material fixing an acoustic transducer array therein in a watertight manner.

Yet another object of this invention is to provide a solid casting in the shape of a towed body, the towed body housing a plurality of fixed and environmentally protected acoustic transducers therein.

In accordance with one aspect of this invention, there is provided an encapsulation assembly. The encapsulation assembly includes a housing having a nose end, a tail end, and a body portion between the nose end and the tail end. A plurality of acoustic transducers are positioned within the housing, each of the plurality of acoustic transducers having a wiring connection attached thereto. A tow cable is connected to the nose end of the towed body and is in communication with a wiring connection from each of the plurality of acoustic transducers. A characteristic of the assembly is that the solid plastic material is formed in the shape of at least the body portion of the housing thereby environmentally isolating the plurality of acoustic transducers within the housing. Embedding transducers in a solid material has been described previously by Ruffa and Stottlemyer (U.S. Pat. No. 6,050,361). However, the unique aspect of the present invention is that the acoustic elements are not only embedded in the solid material, but the material is cast in the shape of a towed body.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

The single FIGURE is a side sectional view of a solid casting towed body assembly according to the preferred embodiment of the present invention.

DESCRIPTION OF THE PREFERRED EMBODIMENT

Figure 1:
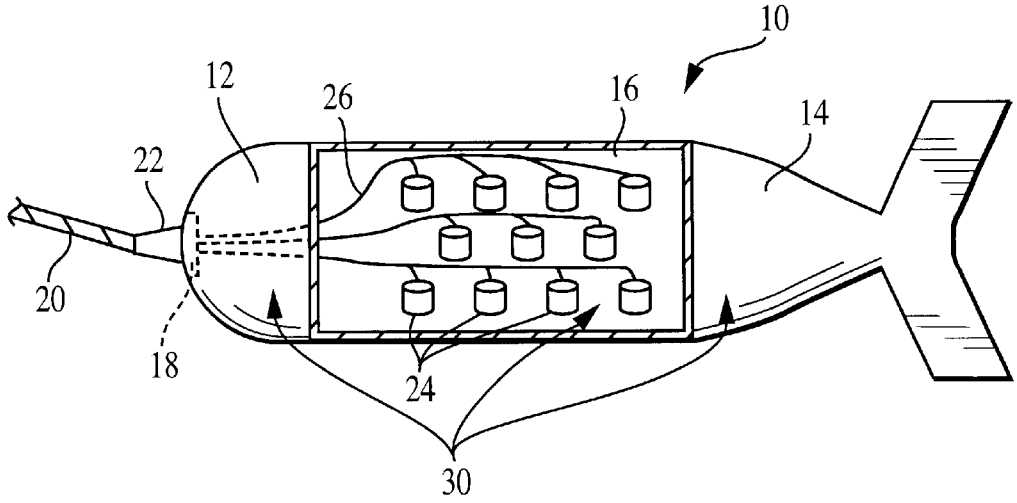

Referring to the FIGURE, a towed body is generally shown as element 10. The towed body 10 includes a nose end 12, a tail end 14, and a body portion 16 intermediate the nose and tail ends. At the nose end 12 of the towed body 10, a termination connection 18 is provided. A tow cable 20 having a tow cable termination 22 at one end thereof is shown whereby the tow cable termination 22 engages with the tow body termination connection 18 as shown. The exact nature of this connection is known to one skilled in the art and, therefore will not be set forth as a primary characteristic of the present invention.

A plurality of electrical elements 24 (such as acoustic transducers) are housed within the main body portion 16 of the towed body 10. Each of the plurality of transducers 24 has an electrical conductor 26 attached thereto. A remaining end of each electrical conductor 26 is inserted into the tow body termination connection 18 and then to the tow cable 20 itself. As is known in the art, the tow cable 20 is the conduit for the plurality of electrical connectors 26 and the mechanical connection to another body such as a surface ship or submarine (not shown).

Characteristic of the present invention is the formation of the tow body 10, including the nose portion, tail portion, and body portion, of a solid casting 30 of rubber or polyurethane in the shape of the towed body 10 while housing the plurality of acoustic transducers 24 therein. By a solid rubber casting or the like, the transducer elements 24 are fixed so as to be physically embedded within the towed body 10 and remains in a volumetric array relative to each other.

It is anticipated, for the sake of simplification in manufacture, that the entire towed body 10 is formed with the solid casting material 30. It is within the scope of the invention, however, to only form the body portion 16 of the solid casting material 30. Any additional part such as the nose 12 and/or tail 14 may then be separate casting material as desired.

Materials such as rho-c rubber may be used in the casting, or various types of urethane for higher strength, as long as the acoustic properties of the material are matched as close as possible to that of water (e.g., density and speed of sound). As described in the aforementioned patent, the solid material increases the cavitation threshold and allows the transducers 24 of a transducer array to be driven to higher acoustic intensities. As shown in the Figure, the towed body 10 could be designed in a nose-tow configuration, with a hemi-spherical nose 12, cylindrical body 16, and tail 14 for stability. There are many alternate shapes that could be built using the technique described by this invention such as top-tow, rectangular body, wings and the like. The tow cable 20 will be attached to a metal termination 22 at the front of the body, which would be attached to a limited amount of metal structure within the body 18 to help sustain the towing loads that would be imposed.

The device is particularly adapted for use in any oceanographic application where active acoustic emissions are required such as oil exploration, fishing, and the like.

The primary advantage of this invention is that the entire tow body is a solid block of material such as urethane. This provides substantial benefits including that the transducers 24 do not need watertight boots since the plastic will prevent water intrusion. Further, the cavitation threshold is increased since the transducers 24 are surrounded by a solid instead of the water. There is no need to assemble various pieces for the towed body 10 since it is a solid plastic object and manufacturing thereof is simple. This type of towed body 10 would provide a simple, rugged, lightweight body that is resistant to cavitation, thereby increasing the source level that can be transmitted by the transducer array. Still further, during deployment and retrieval, the body will not be easily damaged. The system can be built at a low-cost and be disposable. There will be no acoustic reflections from the metal parts that make up traditional towed bodies, and the system will be lightweight compared to traditional metal bodies.

Accordingly, the inventor has discovered that a modification may be made to the existing towed body structure with a minimal expenditure of funds and a minimal impact on acoustic arrays so that a lightweight and reliable device is obtained.

In view of the above detailed description, it is anticipated that the invention herein will have far reaching applications other than those of underwater vehicles.

This invention has been disclosed in terms of certain embodiments. It will be apparent that many modifications can be made to the disclosed apparatus without departing from the teachings of the subject invention. Therefore, it is the intent of the appended claims to cover all such variations and modifications as come within the true spirit and scope of this invention.

What is claimed is:

1. A cable towed encapsulation assembly comprising:

a housing having a nose end, a tail end, and a body portion between the nose end and the tail end;

a plurality of electronic members positioned within the body portion of said housing, each said plurality of electronic members having a wiring connection attached thereto;

a tow body termination member formed on an inner surface of said housing nose end for securing the wiring connections of said plurality of electronic members;

a tow cable termination member connected to an outer surface of said housing nose end and attached to said tow body termination member;

a tow cable connected to said tow cable termination member and sheathing the wiring connection from each of said plurality of electronic members such that towing loads are primarily sustained by said tow body and tow cable termination members; and a solid material forming an entirety of at least the body portion of said housing thereby isolating said plurality of electronic members within said housing.

2. The assembly according to claim 1 wherein said plurality of electronic members is a transducer array.

3. The sembly according to claim 1 wherein each of said plurality of electronic members is a ceramic element.

4. The assembly according to claim 1 wherein said housing is in the shape of a substantially cylindrical towed body.

5. The assembly according to claim 1 wherein said housing is formed in a tubular shape.

6. The assembly according to claim 1 wherein at least said nose portion and said body portion of said housing are formed of a solid casting material.

7. The assembly according to claim 1 wherein an entirety of said housing is formed of a solid casting material in the shape of a towed body.

* * * * *